US010887717B2

(12) United States Patent
Wardle et al.

(10) Patent No.: US 10,887,717 B2
(45) Date of Patent: Jan. 5, 2021

(54) METHOD FOR ACOUSTICALLY RENDERING THE SIZE OF SOUND A SOURCE

(71) Applicant: Sony Interactive Entertainment Inc., Tokyo (JP)

(72) Inventors: Scott Wardle, Foster City, CA (US); Robert Pullman, San Jose, CA (US)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 16/509,257

(22) Filed: Jul. 11, 2019

(65) Prior Publication Data

US 2020/0021939 A1 Jan. 16, 2020

Related U.S. Application Data

(60) Provisional application No. 62/697,269, filed on Jul. 12, 2018.

(51) Int. Cl.

| | |
|---|---|
| ***H04S 7/00*** | (2006.01) |
| ***H04R 5/02*** | (2006.01) |
| ***H04R 5/04*** | (2006.01) |

(52) U.S. Cl.

CPC ..... *H04S 7/303* (2013.01); *H04R 5/02* (2013.01); *H04R 5/04* (2013.01); *H04S 2400/11* (2013.01); *H04S 2400/13* (2013.01); *H04S 2420/01* (2013.01); *H04S 2420/11* (2013.01)

(58) Field of Classification Search

CPC ..... H04S 2400/11; H04S 2420/01; H04S 2420/11; H04S 7/303; H04S 2400/13; H04R 5/02; H04R 5/04

See application file for complete search history.

(56) References Cited

U.S. PATENT DOCUMENTS

| | | | | |
|---|---|---|---|---|
| 5,757,927 | A | 5/1998 | Gerzon et al. | |
| 10,425,762 | B1 * | 9/2019 | Schissler ..... | H04S 7/303 |
| 2012/0213375 | A1 | 8/2012 | Mahabub et al. | |

(Continued)

FOREIGN PATENT DOCUMENTS

| | | | |
|---|---|---|---|
| WO | 2017125821 | A1 | 7/2017 |
| WO | 2018026963 | A1 | 2/2018 |
| WO | 2018060550 | A1 | 4/2018 |

OTHER PUBLICATIONS

International Search Report and Written Opinion dated Oct. 21, 2019 for International Patent Application No. PCT/US2019/041441.

(Continued)

*Primary Examiner* — David L Ton

(74) *Attorney, Agent, or Firm* — JDI Patent; Joshua D. Isenberg; Robert Pullman

(57) ABSTRACT

A method for simulation of movement of a sound source comprising convolving a source wave form with at least an Head Related Transfer Function (HRTF) to generate a point sound source at a simulated first distance from the listener, generating a spherical harmonic representation of the source waveform at a simulated second distance from the listener, crossfading the sound level of the point sound source and the spherical harmonic representation of the source waveform at a simulated second distance from the listener and driving a speaker with the cross-faded spherical harmonic representation of the source waveform and the point sound source.

22 Claims, 4 Drawing Sheets

(56) References Cited

U.S. PATENT DOCUMENTS

| | | | | |
|---|---|---|---|---|
| 2014/0270245 | A1 | 9/2014 | Elko et al. | |
| 2014/0355794 | A1 | 12/2014 | Morrell et al. | |
| 2014/0355796 | A1* | 12/2014 | Xiang | G10L 19/008 381/303 |
| 2015/0170657 | A1 | 6/2015 | Thompson et al. | |
| 2015/0213803 | A1* | 7/2015 | Peters | G10L 19/008 704/500 |
| 2015/0332683 | A1* | 11/2015 | Kim | G10L 19/008 704/500 |
| 2016/0037282 | A1* | 2/2016 | Giron | H04S 7/30 381/303 |
| 2016/0119737 | A1* | 4/2016 | Mehnert | H04S 7/306 381/310 |
| 2016/0302005 | A1 | 10/2016 | Fedosov et al. | |
| 2017/0366912 | A1* | 12/2017 | Stein | H04S 7/304 |
| 2018/0359594 | A1* | 12/2018 | Maeno | H04R 3/00 |
| 2019/0313200 | A1* | 10/2019 | Stein | G06F 3/04845 |
| 2019/0356999 | A1* | 11/2019 | Raghuvanshi | G10K 15/08 |
| 2019/0379992 | A1* | 12/2019 | Schmidt | H04R 1/1041 |

OTHER PUBLICATIONS

J. Driscoll and D. Healy, "Computing Fourier Transforms and Convolutions on the 2-Sphere," Adv. Appl. Math., vol. 15, No. 2, pp. 202-250, Jun. 1994.

Matthias Kronlachner, Master's Thesis: "Spatial Transformations for the Alteration of Ambisonic Recordings", Institute of Electronic Music and Acoustics University of Music and Performing Arts, Graz Graz University of Technology, Graz, Austria, Jun. 2014.

Zotter Franz, "Sampling Strategies for Acoustic Holography/Holophony on the Sphere," in NAG-DAGA, 2009.

Zotter, Franz, "Analysis and Synthesis of Sound-Radiation with Spherical Arrays", PhD dissertation, University of Music and Performing Arts, Graz, Austria, 2009.

* cited by examiner

METHOD FOR ACOUSTICALLY RENDERING THE SIZE OF SOUND A SOURCE

CLAIM OF PRIORITY

This application claims the priority benefit of U.S. Provisional Patent Application No. 62/697,269 filed Jul. 12, 2018, the entire contents of which are incorporated herein by reference.

FIELD

The present disclosure relates to audio signal processing and sound localization. In particular, aspects of the present disclosure relate to simulating the size of sound source a multi-speaker system.

BACKGROUND

Human beings are capable of recognizing the source location, i.e., distance and direction, of sounds heard through the ears through a variety of auditory cues related to head and ear geometry, as well as the way sounds are processed in the brain. Surround sound systems attempt to enrich the audio experience for listeners by outputting sounds from various locations which surround the listener.

Typical surround sound systems utilize an audio signal having multiple discrete channels that are routed to a plurality of speakers, which may be arranged in a variety of known formats. For example, 5.1 surround sound utilizes five full range channels and one low frequency effects (LFE) channel (indicated by the numerals before and after the decimal point, respectively). For 5.1 surround sound, the speakers corresponding to the five full range channels would then typically be arranged in a room with three of the full range channels arranged in front of the listener (in left, center, and right positions) and with the remaining two full range channels arranged behind the listener (in left and right positions). The LFE channel is typically output to one or more subwoofers (or sometimes routed to one or more of the other loudspeakers capable of handling the low frequency signal instead of dedicated subwoofers). A variety of other surround sound formats exists, such as 6.1, 7.1, 10.2, and the like, all of which generally rely on the output of multiple discrete audio channels to a plurality of speakers arranged in a spread out configuration. The multiple discrete audio channels may be coded into the source signal with one-to-one mapping to output channels (e.g. speakers), or the channels may be extracted from a source signal having fewer channels, such as a stereo signal with two discrete channels, using other techniques like matrix decoding to extract the channels of the signal to be played.

Surround sound systems have become popular over the years in movie theaters, home theaters, and other system setups, as many movies, television shows, video games, music, and other forms of entertainment take advantage of the sound field created by a surround sound system to provide an enhanced audio experience. However, there are several drawbacks with traditional surround sound systems, particularly in a home theater application. For example, creating an ideal surround sound field is typically dependent on optimizing the physical setup of the speakers of the surround sound system, but physical constraints and other limitations may prevent optimal setup of the speakers. Additionally for interactive media like video games simulation of the location of sound is not as precise as the speakers are only used to convey information based on the location of each channel. Providing precise simulation of the location of sound is further hampered by the need to eliminate cross talk which occurs between each of the speakers in the system. One solution that has been used is using headphone systems. Many Headphones eliminate systems eliminate cross talk by tightly coupling the headphones to the listener's head so that there is no mixing between the left and right signals.

One persistent difficulty with sound systems is simulation of the location of a sound source. It has been proposed that the source location of a sound can be simulated by manipulating the underlying source signal using a technique referred to as "sound localization." Some known audio signal processing techniques use what is known as a Head Related Impulse Response (HRIR) function or Head Related Transfer Function (HRTF) to account for the effect of the user's own head on the sound that reaches the user's ears. An HRTF is generally a Fourier transform of a corresponding time domain Head Related Impulse Response (HRIR) and characterizes how sound from a particular location that is received by a listener is modified by the anatomy of the human head before it enters the ear canal. Sound localization typically involves convolving the source signal with an HRTF for each ear for the desired source location. The HRTF may be derived from a binaural recording of a simulated impulse in an anechoic chamber at a desired location relative to an actual or dummy human head, using microphones placed inside of each ear canal of the head, to obtain a recording of how an impulse originating from that location is affected by the head anatomy before it reaches the transducing components of the ear canal.

For virtual surround sound systems involving headphone playback, the acoustic effect of the environment also needs to be taken into account to create a surround sound signal that sounds as if it were naturally being played in some environment, as opposed to being played directly at the ears or in an anechoic chamber with no environmental reflections and reverberations. Accordingly, some audio signal processing techniques model the impulse response of the environment, hereinafter referred to as the "room impulse response" (RIR), using synthesized room impulse response function that is algorithmically generated to model the desired environment, such as a typically living for a home theater system. These room impulse response functions for the desired locations are also convolved with the source signal in order to simulate the acoustic environment, e.g. the acoustic effects of a room.

A second approach to sound localization is to use a spherical harmonic representation of the sound wave to simulate the sound field of the entire room. The spherical harmonic representation of a sound wave characterizes the orthogonal nature of sound pressure on the surface of a sphere originating from a sound source and projecting outward. The spherical harmonic representation allows for a more accurate rendering of large sound sources as there is more definition to the sound pressure of the spherical wave. Spherical harmonic sound representations have drawbacks in that transformation of a sound wave to a spherical representation is computationally expensive and complex to calculate. Additionally the spherical harmonic representation typically has a relatively small "sweet spot" where the sound localization is optimum and listeners can experience the most definition for sound locations. Surround sound systems that use spherical harmonics called Ambisonics have been in development since the 1970s and there have been several attempts to make Ambisonic surround sound systems but these systems have not been successful. It is within this context that aspects of the present disclosure arise.

BRIEF DESCRIPTION OF THE DRAWINGS

The teachings of the present disclosure can be readily understood by considering the following detailed description in conjunction with the accompanying drawings, in which.

DETAILED DESCRIPTION

Figure 1A:
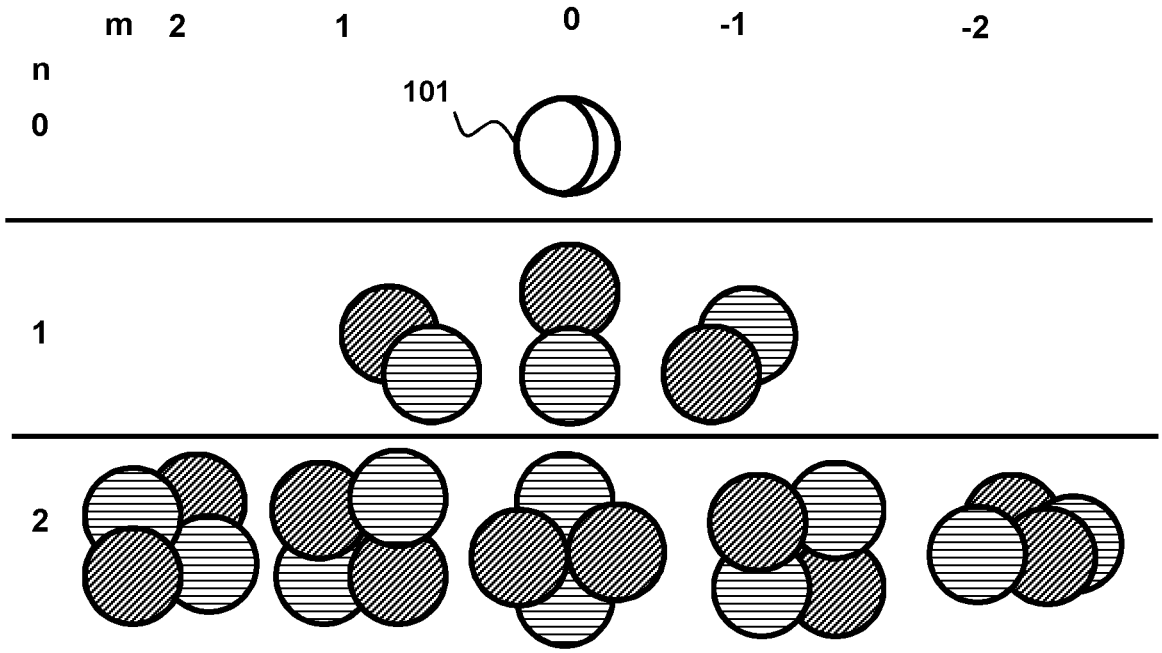
FIG. 1A (PRIOR ART)
FIG. 1A is a diagram of the first two orders and degrees of spherical harmonics according to aspects of the present disclosure.

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

Introduction

Aspects of the present disclosure relate to localization of sound in a sound system. Specifically the present disclosure relates transitioning between a point sound source simulation and a spherical harmonic representation of sound during the movement of a sound source towards or away from a listener. Typically in a sound system each speaker is connected to a main controller, sometimes referred to as an amplifier but may also take the form of a computer or game console. Each speaker unit in the sound system has a defined data path used to identify the individual unit, called a channel. In most modern speaker systems the overall amplitude or volume of each channel is controllable with the main controller. Additionally each speaker unit may also comprise several individual speakers that have different frequency response characteristics. For example a typical speaker unit comprises both a high range speaker, sometimes referred to as a tweeter and a mid-ranged speaker. These individual speakers typically cannot have their volume controlled individually thus for ease of discussion speaker hereafter will refer to a speaker unit meaning the smallest amount of speakers that can be have its volume controlled.

Sound Localization Through Application of Transfer Functions

One way to create localized sound is through a binaural recording of the sound at some known location and orientation with respect to the sound source. High quality binaural recordings may be created with dummy head recorder devices made of materials which simulate the density, size and average inter-aural distance of the human head. In creation of these recordings, information such as inter-aural time delay and frequency dampening due to the head is captured within the recording.

Techniques have been developed that allow any audio signal to be localized without the need to produce a binaural recording for each sound. These techniques take a source sound signal which is in the amplitude over time domain and apply a transform to the source sound signal to place the signal in the frequency amplitude domain. The transform may be a Fast Fourier transform (FFT), Discrete Cosine Transform (DCT) and the like. Once transformed the source sound signal can be convolved with a Head Related Transfer Function (HRTF) through point multiplication at each frequency bin.

The HRTF is a transformed version of the Head Related Impulse Response (HRIR) which captures the changes in sound emitted at a certain distance and angle as it passes between the ears of the listener. Thus the HRTF may be used to create a binaural version of a sound signal located at a certain distance from the listener. An HRIR is created by making a localized sound recording in an anechoic chamber similar to as discussed above. In general a broadband sound may be used for HRIR recording. Several recordings may be taken representing different simulated distances and angles of the sound source in relation to the listener. The localized recording is then transformed and the base signal is deconvolved with division at each frequency bin to generate the HRTF.

Additionally the source sound signal may be convolved with a Room Transfer Function (RTF) through point multiplication at each frequency bin. The RTF is the transformed version of the Room Impulse Response (RIR). The RIR captures the reverberations and secondary waves caused by reflections of source sound wave within a room. The RIR may be used to create a more realistic sound and provide the listener with context for the sound. For example and without limitation an RIR may be used that simulates the reverberations of sounds within a concert hall or within a cave. The signal generated by transformation and convolution of the source sound signal with an HRTF followed by inverse transformation may be referred to herein as a point sound source simulation.

The point source simulation recreates sounds as if they were a point source at some angle from the user. Larger sound sources are not easily reproducible with this model as the model lacks the ability to faithfully reproduce differences in sound pressure along the surface of the sound wave. Sound pressure differences which exist on the surface of a traveling sound wave are recognizable to the listener when a sound source is large and relatively close to the listener.

Sound Localization Through Spherical Harmonics

One approach to simulating sound pressure differences on the surface of a spherical sound wave is Ambisonics. Ambisonics as discussed above, models the sound coming from a speaker as time varying data on the surface of a sphere. A sound signal f(t) arriving from location θ.

$$\theta = \begin{pmatrix} \theta_x \\ \theta_y \\ \theta_x \end{pmatrix} = \begin{pmatrix} \cos\varphi\cos\vartheta \\ \sin\varphi\cos\vartheta \\ \sin\varphi \end{pmatrix} \quad \text{(eq. 1)}$$

Where φ is the azimuthal angle in the mathematic positive orientation and ϑ is the elevation of the spherical coordinates. This surround sound signal, $f(\varphi, \vartheta, t)$ may then be described in terms of spherical harmonics where each increasing N order of the harmonic provides a greater degree of spatial recognition. The Ambisonic representation of a sound source is produced by spherical expansion up to an Nth truncation order resulting in (eq. 2).

$$f(\varphi,\vartheta,t)=\Sigma_{n=0}^{N}\Sigma_{m=-n}^{n}Y_n^m(\varphi,\vartheta)\phi_{nm}(t) \quad \text{(eq. 2)}$$

Where $Y^m_n$ represents spherical harmonic matrix of order n and degree m (see FIG. 1A) and $\phi_{mn}(t)$ are the expansion coefficients. Spherical harmonics are composed of a normalization term $N_n^{|m|}$, the legendre function $P_n^{|m|}$ and a trigonometric function.

$$Y_n^m(\varphi, \vartheta) = N_n^{|m|}P_n^{|m|}(\sin(\vartheta))\begin{cases}\sin|m|\vartheta, \text{ for } m < 0\\ \cos|m|\vartheta, \text{ for } m \geq 0\end{cases} \quad \text{(eq. 3)}$$

Where individual terms can be of $Y_n^m$ can be computed through a recurrence relation as described in *Zotter, Franz*, "Analysis and Synthesis of Sound-Radiation with Spherical Arrays," Ph.D. dissertation, University of Music and Performing Arts, Graz, 2009 which is incorporated herein by reference.

Conventional Ambisonic sound systems require a specific definition for expansion coefficients $\phi_{nm}(t)$ and Normalization terms $N_n^{|m|}$. One traditional normalization method is through the use of a standard channel numbering system such as the Ambisonic Channel Numbering (ACN). ACN provides for fully normalized spherical harmonics and defines a sequence of spherical harmonics as $ACN=n^2+n+m$ where n is the order of the harmonic and m, is the degree of the harmonic. The normalization term for ACN is (eq. 4)

$$N_n^{|m|} = \sqrt{\frac{(2n+1)(2-\delta m)}{4\pi}\frac{(n-|m|)!}{(n-|m|)!}} \quad \text{(eq. 4)}$$

ACN is one method of normalizing spherical harmonics and it should be noted that this is provided by way of example and not by way of limitation. There exist other ways of normalizing spherical harmonics which have other advantages. One example, provided without limitation, of an alternative normalization technique is Schmidt semi-normalization.

Manipulation may be carried out on the band limited function on a unit sphere $f(\theta)$ by decomposition of the function in to the spherical spectrum $\phi_N$ using a spherical harmonic transform which is described in greater detail in J. Driscoll and D. Healy, "Computing Fourier Transforms and Convolutions on the 2-Sphere," *Adv. Appl. Math.*, vol. 15, no. 2, pp. 202-250, June 1994 which is incorporated herein by reference.

$$\text{SHT}\{f(\theta)\}=\phi_N=\int_{S^2}y_N(\theta)f(\theta)d\theta \quad \text{(eq. 5)}$$

Similar to a Fourier transform the spherical harmonic transform results in a continuous function which is difficult to calculate. Thus to numerically calculate the transform a Discrete Spherical Harmonic Transform is applied (DSHT). The DSHT calculates the spherical transform over a discrete number of direction $\Theta=[\theta_1, \ldots \theta_L]^T$ Thus the DSHT definition result is;

$$\text{DSHT}\{f(\Theta)\}=\phi_N=Y_N^{\dagger}(\Theta)f(\Theta) \quad \text{(eq, 6)}$$

Where † represents the moore-penrose pseudo inverse $$Y^{\dagger}=(Y^TY)^{-1}Y^T \quad \text{(eq. 7)}$$

The Discrete Spherical harmonic vectors result in a new matrix $Y_N(\Theta)$ with dimensions $L*(N+1)^2$. The distribution of sampling sources for discrete spherical harmonic transform may be described using any known method. By way of example and not by way of limitation sampling methods used may be Hyperinterpolation, Guass-Legendre, Equiangular sampling, Equiangular cylindric, spiral points, HEALPix, Spherical t-designs. Methods for sampling are described in greater detail in Zotter Franz, "Sampling Strategies for Acoustic Holography/Holophony on the Sphere," in *NAGDAGA,* 2009 which is incorporated herein by reference. Information about spherical t-design sampling and spherical harmonic manipulation can be found in Kronlachner Matthias "Spatial Transformations for the Alteration of Ambisonic Recordings" Master Thesis, June 2014, Available at http://www.matthiaskronlachner.com/wp-content/uploads/2013/01/Kronlachner_Master_Spatial_Transformations-_Mobile.pdf.

Movement of Sound Sources

The perceived location and distance of sound sources in an Ambisonic system may be changed by weighting the source signal with direction dependent gain $g(\theta)$ and the application of an angular transformation $\mathcal{T}\{\theta\}$ to the source signal direction $\theta$. After inversion of the angular transformation the resulting source signal equation with the modified location $f'(\theta, t)$ is;

$$f'(\theta,t)=g(\mathcal{T}^{-1}\{\theta\})f(\mathcal{T}^{-1}\{\theta\},t) \quad \text{(eq. 8)}$$

The Ambisonic representation of this source signal is related by inserting $f(\theta, t)=y_N^T(\theta)\phi_N(t)$ resulting in the equation;

$$y_N^T(\theta)\phi_N'(t)=g(\mathcal{T}^{-1}\{\theta\})y_N^T(\theta\mathcal{T}^{-1}\{\theta\})\phi_N(t) \quad \text{(eq. 9)}$$

The transformed Ambisonic signal $\phi_N'(t)$ is produced by removing $y_N^T(\theta)$ using orthogonality after integration over two spherical harmonics and application of discrete spherical harmonic transform (DSHT). Producing the equation;

$$\phi_N'(t)=T^*\phi_N(t) \quad \text{(ea. 10)}$$

Where T represents the transformation matrix;

$$T=\text{DHST}\{\text{diag}\{g(\mathcal{T}^{-1}\{\Theta\})\}y_N^T(\Theta\mathcal{T}^{-1}\{\theta\})\}=Y_N^{\dagger}(\Theta)\text{diag}\{g(\mathcal{T}^{-1}\{\Theta\})\}y_N^T(\theta\mathcal{T}^{-1}\{\Theta\}) \quad \text{(eq. 11)}$$

Rotation of a sound source can be achieved by the application of a rotation matrix $T_r^{xyz}$ which is further described in Zotter "Sampling Strategies for Acoustic Holography/Holophony on the Sphere," and Kronlachner.

Sound sources in the Ambisonic sound system may further be modified through warping. Generally a transformation matrix as described in Kronlachner may be applied to warp a signal in any particular direction. By way of example and not by way of limitation a bilinear transform may be applied to warp a spherical harmonic source. The bilinear transform elevates or lowers the equator of the source from 0 to arcsine a for any a between $-1<\alpha<1$. For higher order spherical harmonics the magnitude of signals must also be changed to compensate for the effect of playing the stretched source on additional speakers or the compressed source on fewer speakers. The enlargement of a sound source is described by the derivative of the angular transformation of the source ($\sigma$). The energy preservation after warping then may be provided using the gain fact $g(\mu')$ where;

$$g(\mu`) = \frac{1}{\sqrt{\sigma}} = \frac{\sqrt{1-\alpha^2}}{1-\alpha\mu`} \quad \text{(eq. 12)}$$

Warping and compensation of a source distributes part of the energy to higher orders. Therefore the new warped spherical harmonics will require a different expansion order at higher decibel levels to avoid errors. As discussed earlier these higher order spherical harmonics capture the variations of sound pressure on the surface of the spherical sound wave.

The computations for localization of sound sources in the spherical harmonics representation can be quite involved even for small sources as can be seen from the above discussion. Thus it would be beneficial to create a system that could capture the fidelity of the spherical harmonics representation with the reduced computing requirements of the transfer function model.

Combination Spherical Harmonic and Point Sound Source Simulation

According to aspects of the present disclosure a sound system may crossfade the point sound source simulation with the spherical harmonic representation of the sound source. The sound level crossfade between the two models is performed on the volume/amplitude. The system may determine the level of cross fade based on the simulated location and/or size of a sound source.

Generally sound sources that are far away can be represented as point sources because only a narrow window of the signal is perceivable. This narrow perceivable window does not provide the listener with enough information to recognize higher order harmonic features within the source. Similarly small sources and quiet sources do not produce enough information for the average person to perceive higher order features. In the spherical harmonic representation a far away, small or quiet sound sources may be represented as zeroth order sound signals 101. According to aspects of the present disclosure the far away, small and/or quiet sound sources are represented by point sound source simulation. Larger, louder and/or closer sound sources may be represented by the spherical harmonic representation. The benefit of using the point sound source simulation for far away, small and/or quiet sources is that it requires less computation than the spherical harmonic representation.

Figure 2:
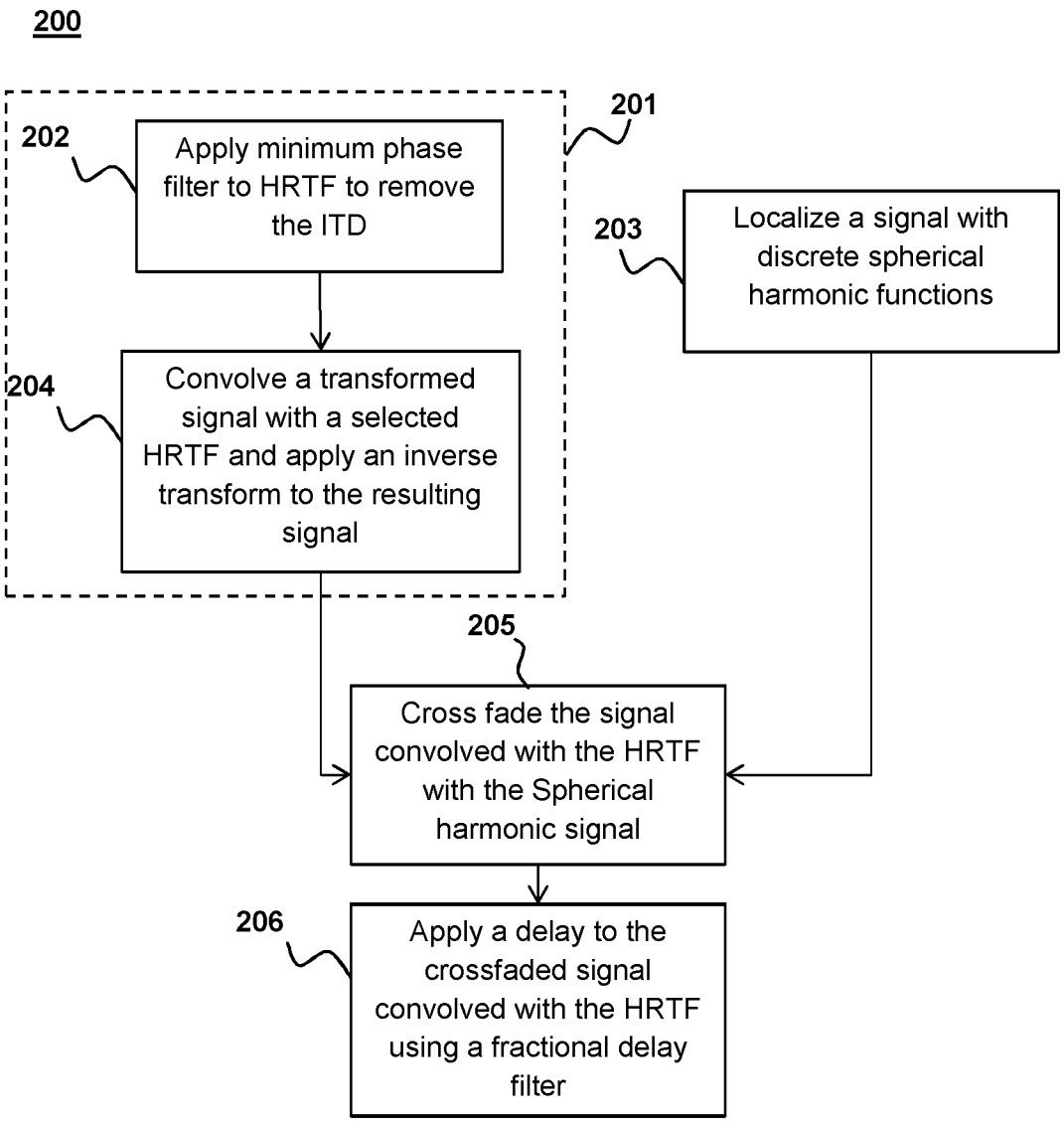
FIG. 2 is a block diagram of a method for transitioning between a point sound source simulation and the spherical harmonic representation according to aspects of the present disclosure.
Figure 3:
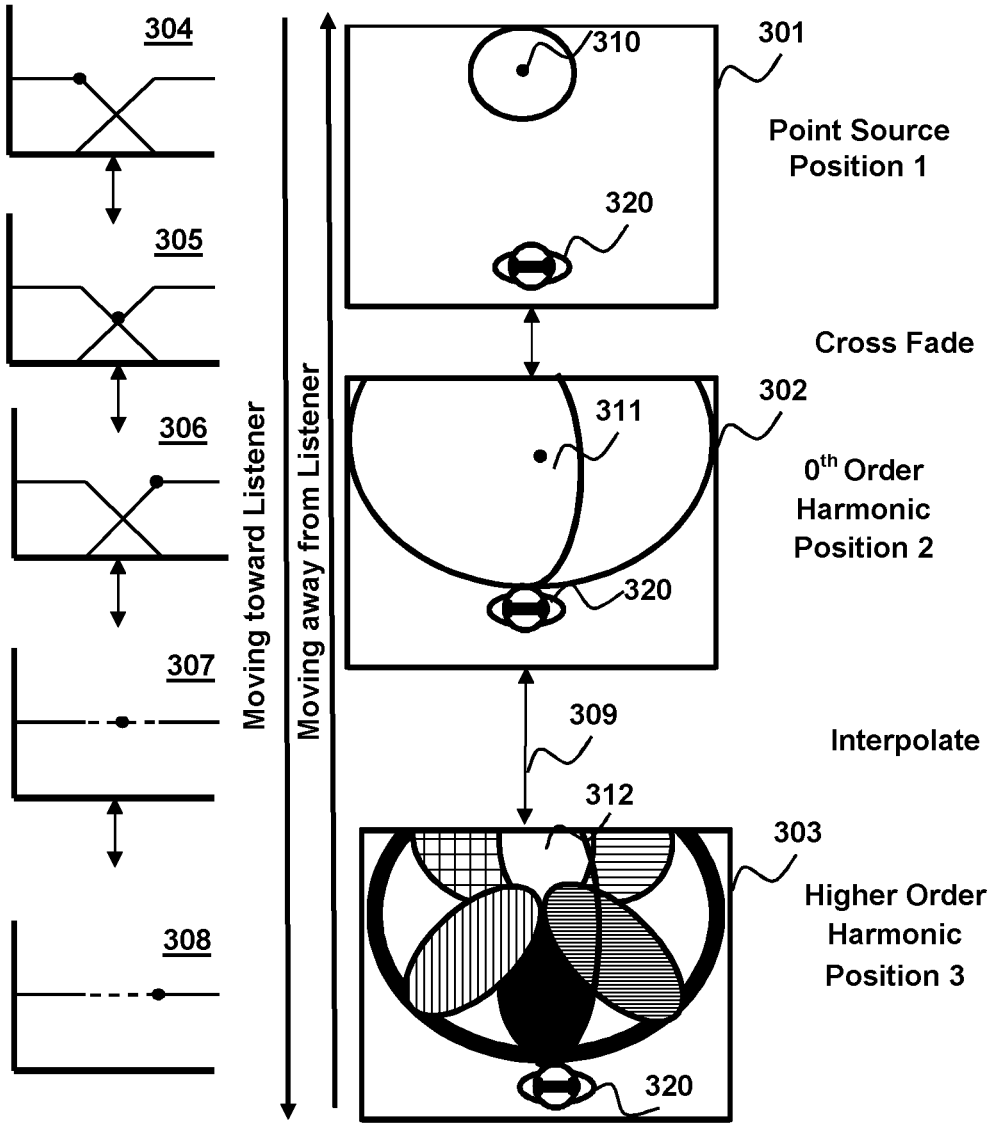
FIG. 3 is a pictorial diagram of the method for transitioning between the point sound source simulation and the spherical harmonic representation according to aspects of the present disclosure.

The simulated locations of sound sources within a sound system are not always fixed and it would be desirable to accurately simulate effect of movement on sound source as it approaches or moves away from the listener. FIGS. 2 and 3 show a method for simulation of movement of a sound source towards or away from a listener 320 according to aspects of the present disclosure. As seen in FIG. 2, a point source representation and a spherical harmonics representation of a sound source waveform may be generated at 201 and 203, respectively, then crossfaded at 205 to generate a crossfaded waveform that drives one or more speakers. The crossfading may be implemented in a way that simulates a change in distance of the sound source from a listener. Generally, the cross-fade 205 may decrease the volume of the point source representation and increase the volume of the spherical harmonics representation as the distance decreases and vice-versa as the distance decreases.

By way of example, and not by way of limitation, the sound source may have a simulated location 301 that is at a point far away from the listener 320. This far away sound source 310 may be localized through transformation and convolution of the signal with an HRIR 212 chosen to simulate the point 310 far away from the user. The simulated location of the sound source may move to a second point 302 closer to the listener 320. The second point 302 may be close enough that the listener 320 would perceive differences in sound pressure on the surface of the spherical sound wave 311 if it were a natural sound. Thus the sound source at the second point 302 should be localized using discrete spherical harmonic functions at 203.

A transition of the source sound between the first point and the second point may be performed by gradually lowering the volume of the transfer function representation while gradually raising the volume of the spherical harmonic representation during the crossfade 205. The volume of the point source simulation may be full while the spherical harmonic representation is zero or not calculated at 304. As the simulated location of the sound sources moves, the volume of both representations is altered. At some point during the transition the volume of the spherical harmonic representation and the point source simulation will be equivalent at 305. When the simulated location of the source moves to some predetermined point from the user 320 the volume of the point source simulation will be attenuated at 306 leaving only the spherical harmonic representation. In an embodiment the cross fade at 305 may be incremented gradually so that each unit of distance the simulated location moves away from the first point and towards the second point corresponds to a linear decrease in the volume of the point sound source simulation and a linear increase in the volume in the spherical harmonic representation. In alternative embodiments the crossfade may be performed as a logarithmic or exponential function with respect to the simulated location of the sound source. Similar to the transition from a far source to a close source the transition from a close source to a far source may be performed by lowering the volume spherical harmonic representation while increasing the volume of the point sound source simulation.

Additionally as the simulated location of the sound source moves from the first point to the second point it may be desirable to apply a second HRIR chosen to simulate a transition point. In this case the first HRIR would be convolved with the source signal and the second HRIR would be convolved with the source signal. In some implementations, as the simulated location of sound source moves from the first point to the transition point the volume level of the two different HRIR convolved signals may be crossfaded incrementally, e.g., the volume level of the source signal convolved with the first HRIR may be decreased and volume level of the second HRIR may be increased as the simulated location of the sound source moves from the first point to the transition point. Alternatively the system may interpolate between the first and second HRTF and convolve the source signal with the Interpolated HRTF. The system may then playback the first HRTF convolved signal, the Interpolated HRTF convolved signal and the second HRTF convolved signal respectively to simulate movement of the location of the sound from the first point to the transition point.

According to additional aspects of the present disclosure in generating the HRTF representation at 201 the Inter-aural time delay may optionally be reduced to zero during the transition between the first simulated location of the sound source and the second simulated location of the sound source. Inter-aural time delay (ITD) captures the time it takes for a sound wave to travel from one ear of the listener to the other ear of the listener. The listener may use the time delay information in the determination of the location of a sound. In general this information is captured by HRIR recordings. The ITD information may be removed from the HRTF recordings through the use of a minimum phase filter 202 or other suitable filter. The ITD may be adjusted during or after convolution of the source signal with the HRTF at 204 and application of the crossfade to the point sound source simulation at 205.

ITD information may be adjusted through the use of a fractional delay filter 206. Fractional delays may be applied to the left or right signal depending on the simulated location of the source in relation to the user's head. By way of example and not by way of limitation if the simulated location of the source is directly left of the listener's head then the right signal will have the greatest delay. Similarly if the signal is in front or behind the listener's head there will be no difference in the delay of the left and right signals. The delay between the left and right signals may be changed fractionally based how far from the center front or center rear of listener the simulated location of the source is.

Figure 1B:
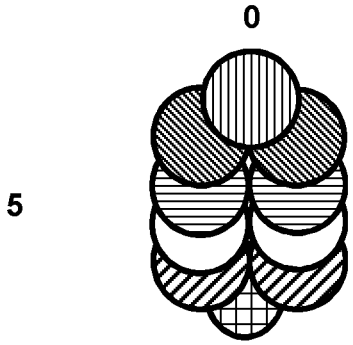
FIG. 1B (Prior Art)
FIG. 1B is a diagram of a fifth order of zeroth degree spherical harmonic according to aspects of the present disclosure.

According to aspects of the present disclosure as the simulated location of the source approaches the listener, the transition between the transfer function model and the spherical harmonic model occurs at the zeroth order spherical harmonic 311. Similarly as the simulated location of the sound source moves away from the user the transition should occur at the zeroth order harmonic 311. It should be understood that as the simulated location of the source moves away from the listener it may be represented by increasingly higher order spherical harmonics 312 representing widening of the sound source. According to additional aspects of the present disclosure as the distance of the sound source from the listener 320 increases it may reach a transition point 303 representing the narrowing extent of the sound source due to distance. Past this transition period 309 the sound source may be represented as the interpolation between the zeroth order harmonic and the previous harmonic order as shown in volume plot 307. On the volume plot 307 in FIG. 3 the interpolation volume is represented by a dotted line. Thus with respect to the volume plot between the higher order spherical harmonic position in volume plot 303 and the zero order spherical harmonic position 302, the global volume remains constant between volume plots 306 and 308 respectively while the properties of the sound pressure along the surface of the sphere change. By way of example and not by way of limitation a source may initially be represented as a $5^{th}$ order spherical harmonic (See FIG. 1B) and as the simulated location in volume plot 303 of the source moves away from the listener 320 the $5^{th}$ order spherical harmonic may be interpolated at 309 with a zeroth order spherical harmonic representation of the source and as the simulated location of the source move further still away 302 from the listener the source may be represented by zeroth order spherical harmonic 311.

System

Figure 4:
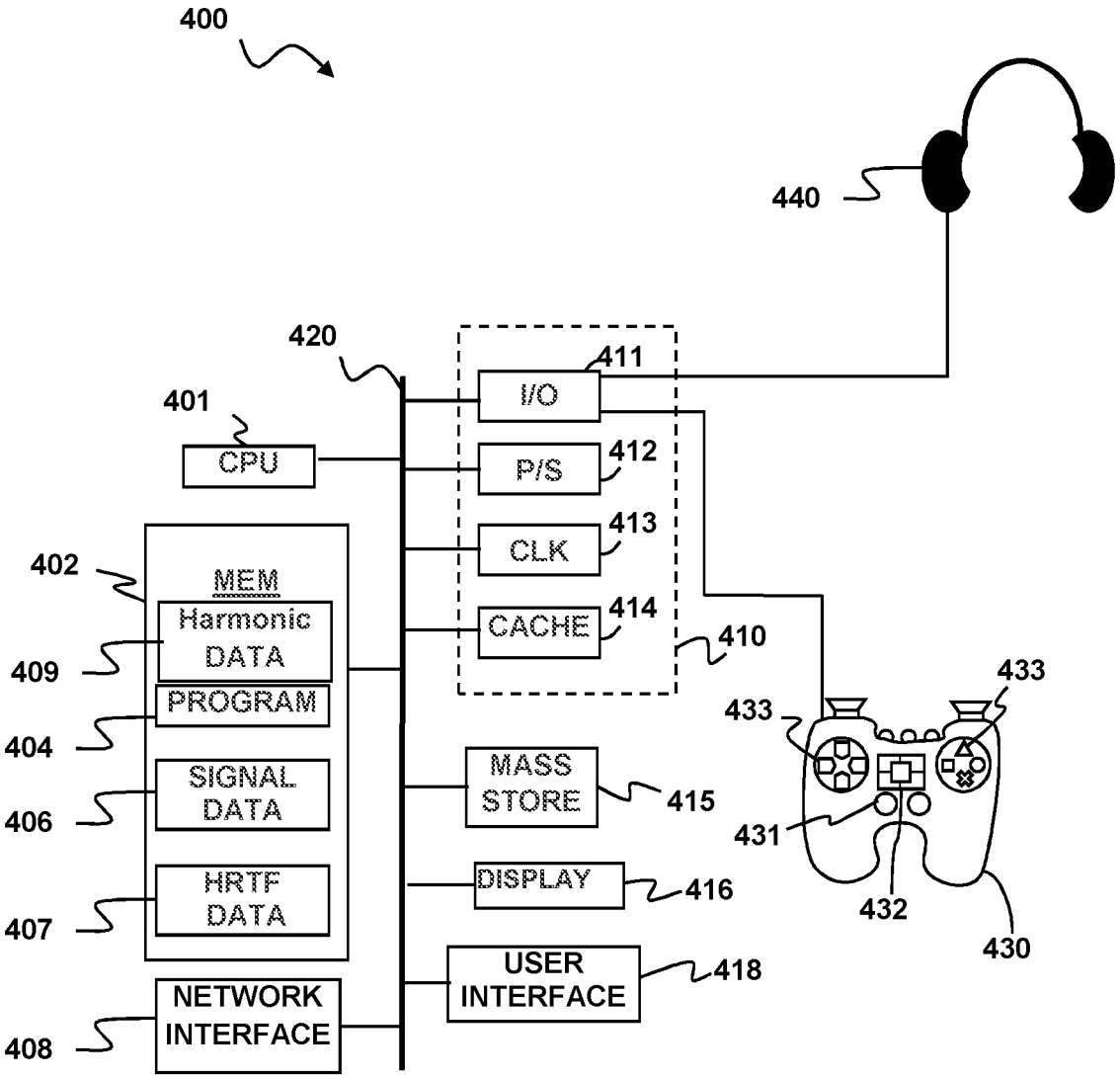
FIG. 4 is a schematic diagram depicting a system for transitioning between a point sound source simulation and the spherical harmonic representation according to aspects of the present disclosure.

Turning to FIG. 4, a block diagram of an example system 400 configured to localize sounds in accordance with aspects of the present disclosure.

The example system 400 may include computing components which are coupled to a sound system 440 in order to process and/or output audio signals in accordance with aspects of the present disclosure. By way of example, and not by way of limitation, in some implementations the sound system 440 may be a set of stereo or surround headphones, some or all of the computing components may be part of a headphone system 440. Furthermore, in some implementations, the system 400 may be part of an embedded system, mobile phone, personal computer, tablet computer, portable game device, workstation, game console, set-top box, standalone amplifier unit and the like.

The example system may additionally be coupled to a game controller 430. The game controller may have numerous features which aid in tracking its location and which may be used to assist in the optimization of sound. A microphone array may be coupled to the controller for enhanced location detection. The game controller may also have numerous light sources that may be detected by an image capture unit and the location of the controller within the room may be detected from the location of the light sources. Other location detection systems may be coupled to the game controller 430, including accelerometers and/or gyroscopic displacement sensors to detect movement of the controller within the room. According to aspects of the present disclosure the game controller 430 may also have user input controls such as a direction pad and buttons 433, joysticks 431, and/or Touchpads 432. The game controller may also be mountable to the user's body.

The system 400 may be configured to process audio signals to de-convolve and convolve impulse responses and generate spherical harmonic signals in accordance with aspects of the present disclosure. The system 400 may include one or more processor units 401, which may be configured according to well-known architectures, such as, e.g., single-core, dual-core, quad-core, multi-core, processor-coprocessor, accelerated processing unit and the like. The system 400 may also include one or more memory units 402 (e.g., RAM, DRAM, ROM, and the like).

The processor unit 401 may execute one or more programs 404, portions of which may be stored in the memory 402, and the processor 401 may be operatively coupled to the memory 402, e.g., by accessing the memory via a data bus 420. The programs may be configured to process source audio signals 406, e.g. for converting the signals to localized signals for later use or output to the headphones 440. The programs may configure the processing unit 401 to generate spherical harmonic Data 409 representing the spherical harmonics of the signal data 406. Additionally the memory 402 may have HRTF Data 407 for convolution with the signal data 406. By way of example, and not by way of limitation, the memory 402 may include programs 404, execution of which may cause the system 400 to perform a method having one or more features in common with the example methods above, such as method 200 of FIG. 2. By way of example, and not by way of limitation, the programs 404 may include processor executable instructions which cause the system 400 to cross fade the a signal convolved with an HRTF with the spherical harmonic signal.

The system 400 may also include well-known support circuits 410, such as input/output (I/O) circuits 411, power supplies (P/S) 412, a clock (CLK) 413, and cache 414, which may communicate with other components of the system, e.g., via the bus 420. The system 400 may also include a mass storage device 415 such as a disk drive, CD-ROM drive, tape drive, flash memory, or the like, and the mass storage device 415 may store programs and/or data. The system 400 may also include a user interface 418 and a display 416 to facilitate interaction between the system 400 and a user. The user interface 418 may include a keyboard, mouse, light pen, touch interface, or other device. The system 400 may also execute one or more general computer applications (not pictured), such as a video game, which may incorporate aspects of surround sound as computed by the sound localizing programs 404.

The system 400 may include a network interface 408, configured to enable the use of Wi-Fi, an Ethernet port, or other communication methods. The network interface 408 may incorporate suitable hardware, software, firmware or some combination thereof to facilitate communication via a telecommunications network. The network interface 408 may be configured to implement wired or wireless communication over local area networks and wide area networks such as the Internet. The system 400 may send and receive data and/or requests for files via one or more data packets over a network.

It will readily be appreciated that many variations on the components depicted in FIG. 4 are possible, and that various ones of these components may be implemented in hardware, software, firmware, or some combination thereof. For example, some features or all features of the convolution programs contained in the memory 402 and executed by the processor 401 may be implemented via suitably configured hardware, such as one or more application specific integrated circuits (ASIC) or a field programmable gate array (FPGA) configured to perform some or all aspects of example processing techniques described herein. It should be understood that non-transitory computer readable media refers herein to all forms of storage which may be used to contain the programs and data including memory 402, Mass storage devices 415 and built in logic such as firmware.

CONCLUSION

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "a", or "an" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method for simulation of movement of a sound source towards or away from a listener, comprising:

convolving a source waveform with at least a Head Related Transfer Function (HRTF) to generate a point sound source signal at a simulated first distance from the listener;

generating a spherical harmonic representation of the source waveform at a simulated second distance from the listener;

crossfading a sound level of the point sound source signal and the spherical harmonic representation of the source waveform at the simulated second distance from the listener as a simulated distances of the listener from the sound source changes to generate a cross-faded waveform;

driving a speaker with the cross-faded waveform.

2. The method of claim 1 wherein the simulated second distance from the listener is less than the simulated first distance from the listener.

3. The method of claim 2 wherein the spherical harmonic representation of the source waveform is a lower order spherical harmonic representation.

4. The method of claim 3 wherein the lower order spherical harmonic is a zeroth order spherical harmonic.

5. The method of claim 3 further comprising: interpolating between the lower order spherical harmonic representation and a higher order spherical harmonic representation at a simulate third distance from the listener wherein the simulated third distance is greater than the second distance and driving the speaker with the interpolation between the lower order spherical harmonic representation and the higher order spherical harmonic representation.

6. The method of claim 1, further comprising removing an inter-aural time delay (ITD) from the HRTF prior to convolution.

7. The method of claim 6 wherein the HRTF is filtered with a minimum phase filter.

8. The method of claim 6 wherein said crossfading the sound level includes applying an ITD to the cross-faded waveform using a fractional delay filter.

9. The method of claim 1, wherein the simulated second distance moves farther from the listener.

10. The method of claim 9 wherein the spherical harmonic representation is a higher order spherical harmonic representation.

11. The method of claim 9 wherein the higher order spherical harmonic is a fifth order spherical harmonic.

12. A system, comprising:

a processor;

a speaker;

a memory coupled to the processor, the memory having executable instructions embodied therein, the instructions being configured to cause the processor to carry out a method for simulation of movement of a sound source towards or away from a listener when executed, the method comprising:

generating a spherical harmonic representation of a source waveform at a simulated second distance from the listener;

crossfading a sound level of the point sound source signal at a first distance from the listener and the spherical harmonic representation of the source waveform at the simulated second distance from the listener as a simulated distances of the sound source changes to generate a cross-faded waveform;

driving the speaker with the cross-faded waveform.

13. The system of claim 12 wherein the spherical harmonic representation of the source waveform is a lower order spherical harmonic representation.

14. The system of claim 13 wherein the lower order spherical harmonic is a zeroth order spherical harmonic.

15. The system of claim 13 further comprising: interpolating between the lower order spherical harmonic representation and a higher order spherical harmonic representation at a simulate third distance from the listener wherein the simulated third distance is less than the second distance from the user and driving the speaker with the interpolation between the lower order spherical harmonic representation and the higher order spherical harmonic representation.

16. The system of claim 12 wherein an inter-aural time delay (ITD) is removed from the HRTF.

17. The system of claim 16 wherein the HRTF is filtered with a minimum phase filter.

18. The system of claim 16 wherein said crossfading includes applying an ITD to the cross-faded point sound source using a fractional delay filter.

19. The system of claim 12, wherein the simulated second distance moves farther from the listener.

20. The system of claim 19 wherein the spherical harmonic representation is a higher order spherical harmonic representation.

21. The system of claim 19 wherein the higher order spherical harmonic is a fifth order spherical harmonic.

22. A non-transitory computer readable medium with executable instructions embodied therein wherein execution of the instructions cause a processor to carry out a method for simulation of movement of a sound source towards or away from a listener comprising:

generating a spherical harmonic representation of the source waveform at a simulated second distance from the listener;

crossfading a sound level of the point sound source signal at a first distance from the listener and the spherical harmonic representation of the source waveform at the simulated second distance from the listener as a simulated distances of the sounds source changes to generate a cross-faded waveform;

driving a speaker with the cross-faded waveform.

* * * * *